United States Patent [19]

Wheeler

[11] Patent Number: 4,809,602

[45] Date of Patent: Mar. 7, 1989

[54] SYSTEM AND METHOD FOR REMOVING AND DISPOSING OF A WEB OF MATRIX WASTE

[75] Inventor: Roger R. Wheeler, Roscoe, Ill.

[73] Assignee: Marti Automatic, Inc., Rockford, Ill.

[21] Appl. No.: 59,025

[22] Filed: Jun. 8, 1987

[51] Int. Cl.[4] ..... B30B 7/00; B30B 15/32

[52] U.S. Cl. ..... 100/35; 100/90; 100/215; 100/218; 100/251; 100/191; 156/267; 29/DIG. 78; 406/175; 406/193

[58] Field of Search ..... 112/282; 156/4, 267, 156/268; 100/245, 218, 251, 35, 173, 215, 295, 90, 91, 45, 191, 192, 241, 269 R; 19/107; 29/DIG. 78, DIG. 83; 137/237, 238, 246; 138/DIG. 3; 406/193, 175

[56] References Cited

U.S. PATENT DOCUMENTS

| | | | |
|---|---|---|---|
| 370,247 | 9/1887 | Cross | 100/241 X |
| 2,409,479 | 10/1946 | Fisher | 29/DIG. 78 X |
| 2,821,092 | 1/1958 | Cordora et al. | 138/DIG. 3 X |
| 3,621,775 | 11/1971 | Dedio et al. | 100/191 |
| 3,636,863 | 1/1972 | Woyden | 100/45 |
| 3,752,066 | 8/1973 | Charles | 100/192 |
| 3,785,281 | 1/1974 | Ligh | 100/215 X |
| 3,853,079 | 12/1974 | Dunne | 112/282 |
| 3,948,167 | 4/1976 | De Feudis | 100/215 |
| 4,072,097 | 2/1978 | Seibel | 100/215 X |
| 4,099,457 | 7/1978 | Hyden | 100/215 X |
| 4,188,872 | 2/1980 | Chrablow | 100/53 |
| 4,241,651 | 12/1980 | Castillo et al. | 100/269 R |
| 4,273,037 | 6/1981 | Ruebesam | 100/91 |
| 4,273,606 | 6/1981 | Trilli | 156/267 X |
| 4,532,860 | 8/1985 | Simson | 100/215 X |
| 4,685,840 | 8/1987 | Wolff | 406/175 X |
| 4,712,404 | 12/1987 | Crout et al. | 100/269 R |

*Primary Examiner*—Andrew M. Falik

*Attorney, Agent, or Firm*—McAndrews, Held & Malloy, Ltd.

[57] ABSTRACT

A system and method for efficiently removing and disposing of a continuous web of matrix waste formed during the high speed manufacture of adhesive backed, pressure sensitive label stock on a printing press. As it leaves the press, the web of matrix waste is formed into a generally tubular rope in a cylindrical eductor. A controlled mixture of a high volume, high air and oil is used to pass the rope of matrix waste through an eductor, into and through a flexible hose, and into a compactor where the rope is compacted into relatively compact bundles. These bundles can then be readily deposited and efficiently stored in waste receptacles.

39 Claims, 4 Drawing Sheets

SYSTEM AND METHOD FOR REMOVING AND DISPOSING OF A WEB OF MATRIX WASTE

BACKGROUND OF THE INVENTION

1. Field of the Invention

The invention concerns systems, components and methods for efficiently removing and disposing of the continuous, generally planar web of matrix waste formed during the high speed manufacture of adhesive backed, pressure sensitive label stock on a printing press.

2. Background Art

Pressure sensitive label stock has been and is manufactured on printing presses. Such presses are generally run at relatively high speeds, that is, up to 500–600 feet per minute. The label stock is made from a continuous web of two ply material. A layer of adhesive adheres the top ply of the web to the bottom ply. At one step during the manufacturing operation, the web is die cut, with the die cutter piercing only the top ply of the web. This die cutting step leaves only the labels, cut from the top ply, adhered to the lower ply. The remainder of the top ply is separated from the lower ply and constitutes a continuous, planar web of unwanted material, called a matrix or web of matrix waste, that has to be removed from the printing press. Desirably this continuous web of matrix waste should be disposed of with a minimum of cost and bother. Because of its adhesive layer or backing, this web of matrix waste is quite sticky and abrasive. It is bulky and generally difficult to handle.

In the past, one system used to remove and dispose of a web of matrix waste involved winding the matrix waste web on a core mounted on top of the printing press. The core is locked to a driven spindle and is controlled by a torque limiter. When the diameter of the roll of matrix waste reaches a maximum size, the full roll is removed and is replaced with a new core.

Another similar system has also been used. It utilizes two spindles. While the web of matrix waste is being wound on one spindle, the other is prepared with a new core. When the winding roll is "full", the web of matrix waste is automatically transferred to the new core. The "full" roll is then removed from the press and replaced with another, new core.

A third system has recently been used. In it, the web of matrix waste is crumpled into a generally tubular "rope" like shape and then this rope leads from the printing press to waste receptacles located near the press. This crumpling is achieved by leading the matrix web through a eductor. A stream of relatively high volume air is introduced about the periphery of the matrix rope, as it passes through the eductor, to carry the matrix rope through a flexible metal conduit that leads the matrix rope from the press to the waste receptacles. The interior of the eductor and the flexible metal conduit has a "non-stick", TEFLON brand coating to facilitate the passage of the matrix rope. This third system is marketed by Fox Trim Away of Charlotte, N.C. 28211.

SUMMARY OF THE INVENTION

The present invention is an improved system and method for efficiently removing and disposing of a continuous, generally planar web of matrix waste formed during the high speed manufacture a adhesive backed, pressure sensitive label stock on a printing press. The present invention also includes an improved compactor that is preferably utilized as a component of this system and to perform this method.

In this improved system and method, the web of matrix waste is formed into a generally tubular rope in a cylindrical eductor. This rope then passes through a flexible hose to a compactor. A controlled mixture of high volume air and oil is used to move the rope of matrix waste through the eductor and flexible hose. The rope of matrix waste is compacted, in the compactor, into relatively compact bundles that can be readily deposited and efficiently stored in waste receptacle.

DETAILED DESCRIPTION OF THE PREFERRED EMBODIMENT OF THE INVENTION

Figure 1:
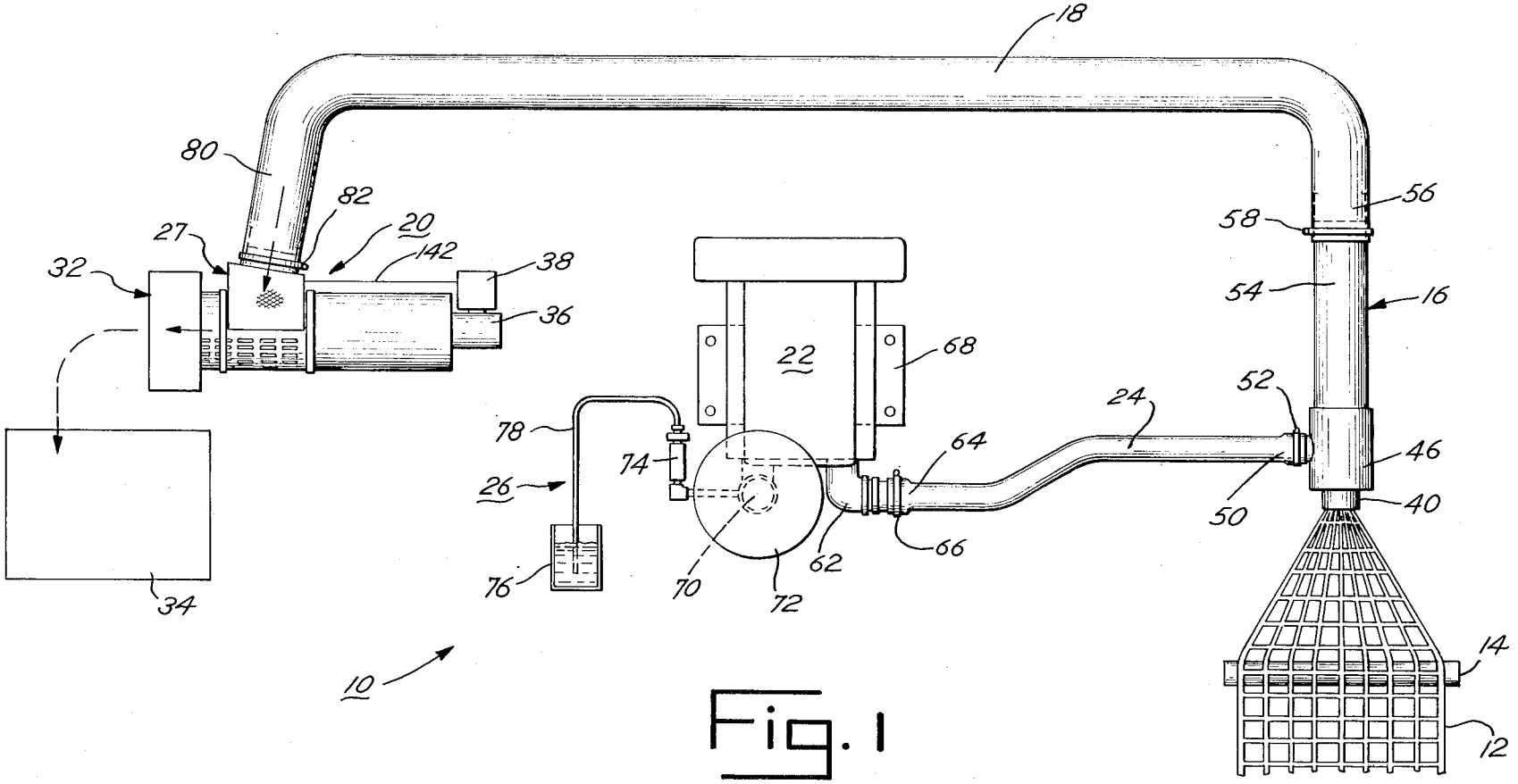
FIG. 1 is an assembly view of the components of the preferred embodiment of the improved system of the present invention.

While this specification concludes with claims particularly pointing out and distinctly claiming the subject matter regarded as the invention, it is believed that a better understanding of the invention can be achieved through careful reading of the following detailed description of the preferred embodiment of the invention in conjunction with a study of the attached drawings.

As noted, the disposal of the continuous web of matrix waste created during the manufacture of adhesive backed, pressure sensitive label stock on a printing press has proved to be a longstanding and vexing problem in the art. The web of matrix waste is relatively fragile. It is difficult to handle as it tends to stick to most everything. The web is also quite abrasive.

In the past, the system most generally used for disposing of the web of matrix waste involved winding the web about a core mounted on the top of the printing press. When a single core is used, the system has the serious drawback in that the printing press had to be stopped each time a roll becomes full. Such press "down time" is obviously an expensive interruption of the manufacturing operation.

Even when two, alternating cores are used, relatively frequently stoppages of the printing press still occurs. Additionally, the fragile web of matrix waste tends to break because the torque imposed on the web varies with the diameter of the matrix wind-up roll. Further breakage can and does happen because not all matrix materials will wind uniformly on a core and the build-up of diameters at the continuous portions of the matrix may not be identical.

The system marketed by Fox Trim Away also has serious drawbacks. Principal of these is the bulk of the rope of matrix waste and how to handle it. This matrix rope quickly fills the waste receptacles; requiring them to be repeatedly and frequently emptied. A chopper unit has to be used to chop the matrix rope into small pieces, but even then, the problem of disposing of the excessive bulk remains. Additionally, build-ups of ink occur in the eductor, and to some extent in the conduit, during the operation of the system. Removal of these build-ups requires the stoppage of the printing press. This may have to be done as often as every three or four hours.

The present invention represents a significant improvement over these prior systems. It is generally similar in approach to the Fox Trim Away system, that is, it employs an eductor to convert the continuous, planar web of matrix waste into a rope of matrix waste, and thus avoids the problems inherent in attempting to wind the web of matrix waste about one or more cores. Nevertheless, it is different from the Fox Trim Away system in that it can be operated for relatively long periods of time without the necessity of stopping the printing press to remove ink build-ups. This is accomplished through mixing relatively small, controlled amounts of oil with the pressurized air used to move the matrix rope.

The present invention also overcomes the serious, practical problem of how to handle efficiently the disposal of the bulky matrix waste. Instead of moving the rope of matrix waste directly, or through a chopper, to waste receptacles, as is done in the Fox Trim Away system, the matrix rope is moved to a compactor where it is pressed into relatively compact bundles that can then be efficiently disposed in waste receptacles. The compactor itself is novel and is particularly adapted to accommodate the matrix waste without undue wear and risk of clogging.

Referring now to FIG. 1, an assembly view of the various components of the improved system 10 of a present invention is shown. While each of the separate components of the system 10 will be described hereinafter in detail, a general description of these components and their inter-relationship will be summarized here.

The system 10 is used, as has been noted, to achieve the efficient removal and disposal of a continuous web of matrix waste 12 created during the high speed manufacture of adhesion backed pressure sensitive label stock on a high speed printing press, not shown. As it leaves the printing press, the web 12 is planar in form with the apertures where the labels were. The matrix web 12 has an adhesive coating that is, at the same time, extremely sticky and abrasive.

As it leaves the printing press, the web 12 passes over and around a roller 14 mounted on the printing press. The roller 14 may be specially installed or an existent roller that was originally installed as part of a system used to wind-up the matrix web on a cardboard core.

After passing around the roller 14, the matrix web 12 enters the inlet of an eductor 16 whereby it is converted from a planar web into a crumpled, tubular rope of matrix waste. After passing through the eductor 16, the matrix rope is moved through a flexible hose 18 that extends between the eductor and a compactor 20. A regenerative blower 22 creates a stream of pressurized air, mixed with oil. This stream of pressurized air and oil is introduced into the eductor 16 and about the periphery of the matrix rope. It serves to move the matrix rope through the eductor 16 and the flexible hose 18. A hose 24 conveys the stream of pressurized air and oil from the regenerative blower 22 to the eductor 16.

The oil is mixed with the air by an oil-addition subassembly 26. As noted above, the advantages of the pressurized air and oil mixture is it facilitates the movement of the matrix rope through the eductor 16 and the flexible hose 18, prevents the build-ups of inks in the eductor and flexible hose, and minimizes the abrasive wear on the eductor and flexible hose caused by passage of the matrix rope.

Figure 2:
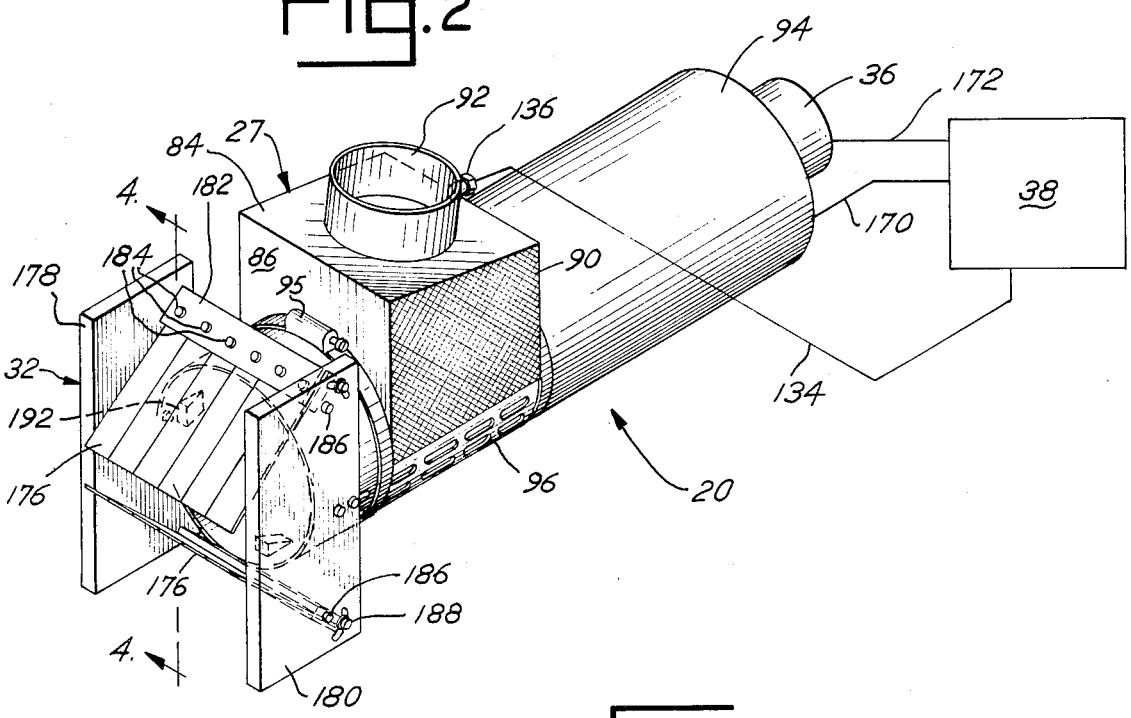
FIG. 2 is a perspective view of the compactor utilized in the improved system of FIG. 1.
Figure 3:
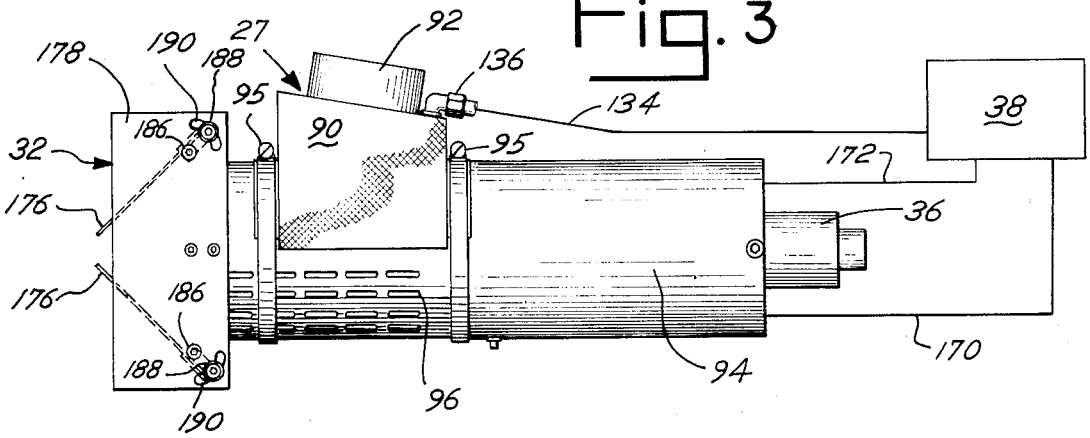
FIG. 3 is a side elevational view of compactor of FIG. 2.
Figure 4:
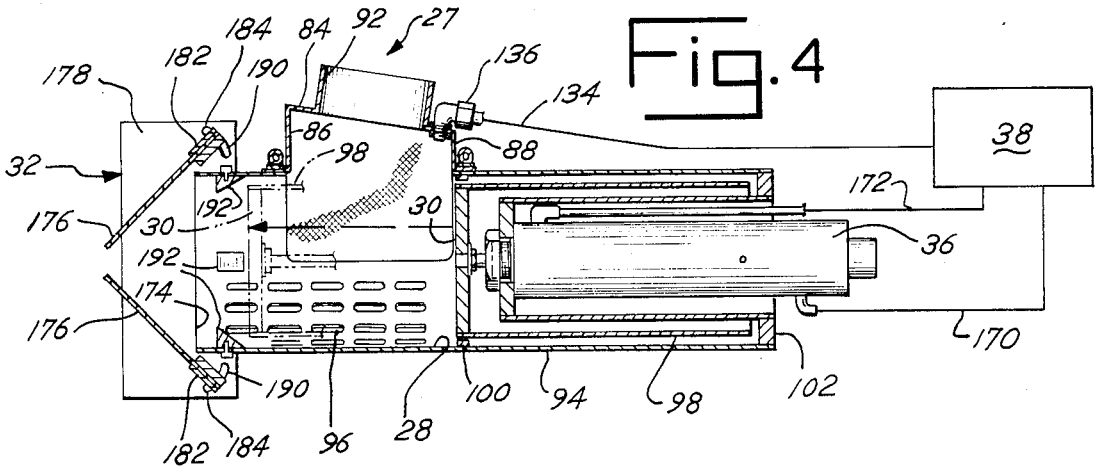
FIG. 4 is a partial cross-sectional view taken along the line 4—4 in FIG. 1.

After being moved through the hose 18, the rope of matrix waste is introduced into an inlet compartment subassembly 27 and then from there into a cylindrical compaction bin or chamber 28, as best shown in FIGS. 2–4. Movement of a reciprocating compacting ram 30 within the bin 28 causes the matrix rope to be compacted into relatively dense bundles of matrix waste. These bundles are ejected from the bin 28, through a steel spring extrusion subassembly 32, also by the movement of the ram 30. They then drop into a waste receptacle 34.

A pneumatic, double acting piston-cylinder subassembly 36 is connected with the ram 30 and its operation causes the ram to move. Operation of the subassembly 36 is controlled by a pneumatic circuit 38, illustrated generally in FIGS. 1–4 and somatically in FIG. 6.

Referring now to a more specific description of the components and subassemblies employed in the system 10, it should be noted that the roller 14 is normally located at the so-called spindle station No. 1 on the top of the printing press. It is mounted for rotation in a conventional manner. To facilitate passage of the continuous planar web of matrix waste 12 around roller 14, the outer peripheral surface of the roller is textured. This can be accomplished by applying an epoxy/silica sand mixture to the periphery of the roller or by applying "VELCRO" material (the "loop" portion) around the roller, although the latter has slightly less effective release characteristics.

Figure 5:
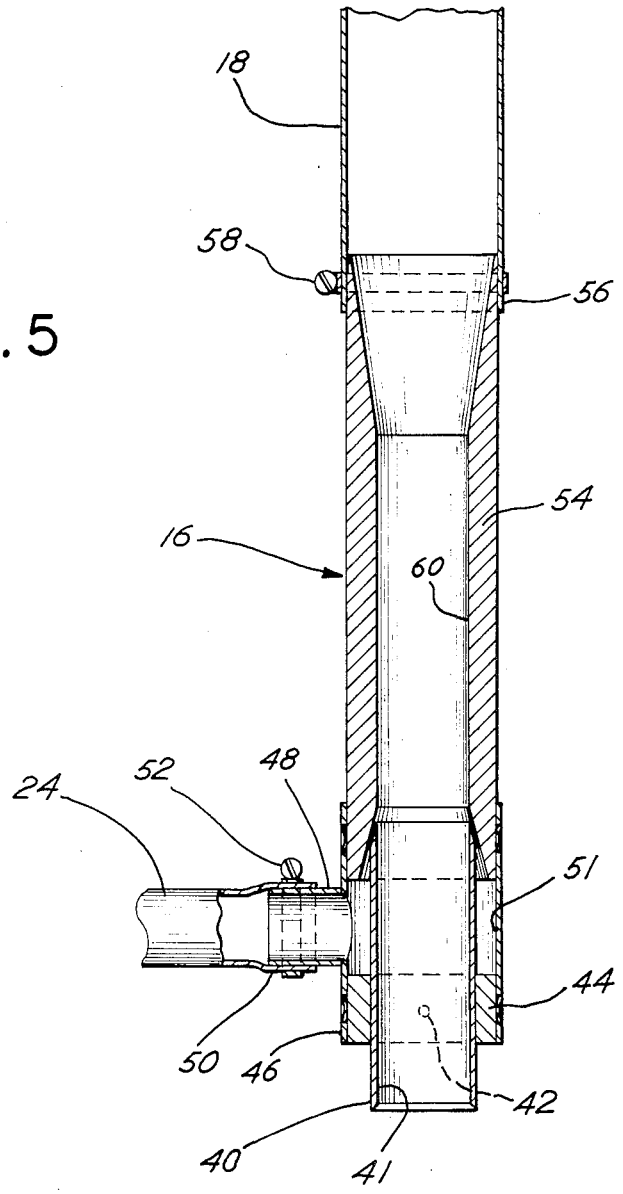
FIG. 5 is a partial cross-sectional view of the eductor, taken along its longitudinal central axis, in the improved system of FIG. 1.

As best shown in FIG. 5, the eductor 16 includes a cylindrical entrance nozzle 40 that has a central passageway 41. The nozzle is mounted in and secured, by one or more set screws 42, to an annular member 44. The member 44 is, in turn, mounted within and secured, by welding, to the upstream end of an outer, cylindrical member 46. An integral, annular neck 48 projects transversely from the side of the member 46, midway between its ends. The neck 48 is received within the end 50 of the hose 24 so that pressurized air and oil, flowing in the hose 24, may pass into the interior 51 of the member 46 downstream from the member 44 and about the nozzle 40. A conventional clamp 52 secures the hose end 50 about the neck 48.

The eductor 16 also includes a second, relatively longer cylindrical member 54 whose upstream end is mounted within and secured, by welding, to the downstream end of the member 46. The downstream end of the member 54 serves as the outlet for the eductor 16 and is received within the end 56 of the flexible hose 18. A conventional clamp 58 secures the hose end 56 about the downstream end of the member 54.

The member 54 includes a central passageway 60. A portion of this passageway 60, inermediate its ends, has a uniform diameter of two and three quarter inches. Its diameter is substantially equal to the diameter of the passageway 41 in the nozzle 40. The longitudinal axes of the passageways 41 and 60 are aligned. The upstream and downstream ends of the passageway 60 flair outwardly so that the diameters of the ends of the passageway are larger than the diameter of the intermediate portion. The diameter of the passageway 60, adjacent the downstream end of the member 54 is substantially equal to the inner diameter of the hose 18.

The downstream end of the nozzle 40 is positioned within the flared portion of the upstream end of the member 54. The downstream end of the nozzle 40 does not, however, contact the member 54. Thus the pressurized air and oil mixture in the interior of the member 46 can and does flow around the downstream end of the nozzle 40, that is, between the downstream end of the nozzle and the member 54, and into the passageway 60. The downstream end of the nozzle 40 tapers inwardly to facilitate this flow.

As noted, the eductor 16 convers the continuous planar or flat web 12 of matrix waste exiting the printing press into a continuous, crumbled tubular rope of matrix waste. To facilitate this coversion and to minimize breakage of the web 12, the eductor 16 should be mounted so that the path of the web, as it passes around the roller 14, is aligned with the longitudinal axes of the passageways 41 and 60. The pressurized air and oil mixture introduced into the eductor 16, through the neck 48, moves the rope of matrix waste through the passageways 41 and 60 of the eductor.

The interior surfaces of the passageways 40 and 60 are coated with a "non-stick" material, such as the material marketed by Whiteford Corporation of Box 507, West Chester, PA 19381 and identified as XYLAN #8414. This coating has excellent release properties for the petroleum based adhesives on the matrix wastes and is quite resistant to abrasive action.

As previously noted, the regenerative blower 22 creates the pressurized air and oil mixture introduced into the eductor 16. More specifically, the discharge 62 of the blower is connected with the neck 48 by the hose 24 which is a two inch diameter hose marketed under the "Tempflex-Plus" trademark by Dayco Corporation of Dayton, Ohio. The other end 64 of the hose 24 is secured to the discharge 62 by a conventional clamp 66.

The blower 22 is of a conventional design, such as Model DR707 marketed by E. G. & G. Rotron of Saugerties, NY. The blower is driven by a 5 h.p., 220 volt 3 phase electrical motor and operates at approximately 60 inches of water pressure and 200 scfm. The blower is sealed against oil leakage and may be mounted by a bracket 68.

Air is drawn into the inlet 70 of the blower 22 through a conventional filter 72. The oil-addition subassembly 26 is used to add small, measured amounts of oil into the inlet 70 of the blower 22. As stated, the mixture of the oil with the air enhances the release characteristics and minimize the wear of the parts of the eductor 16, the hose 18, the subassembly 27 and the compactor 20 that come in contact with the matrix waste. Also and importantly, the mixture prevents build up of inks in these components.

The oil is atomized as it passes through the blower 22 and is metered so as to control the amount of oil added to the inlet. More specifically, the subassembly 26 includes a sight feed needle valve 74 of conventional design such as the valve marketed by McMaster Carr Supply Co., P.O. Box 4355, Chicago, IL 60680, Model No. 1143K11. The preferred flow rate is one drop of oil every five seconds, but this rate may be adjusted depending on the particular adhesive used on the matrix waste. The oil used is commercially available hydrogenated vegetable oil such as sold for cooking, typically in grocery stores. The oil should, however, be clear of any sediment. A bottle of such oil, as shown at 76, may be mounted adjacent to the needle valve 74. A one-quarter inch diameter hose 78 is inserted in the bottle 76 through a cap, not shown, so that the end of the hose extends near the bottom of the bottle. When the blower 22 is operating and the needle valve 74 is set as stated, the system 10 uses approximately one gallon of hydrogenated vegetable oil per one hundred hours of running time.

To minimize the abrasion, the hose 18 is made of an elastomer/urethane material. A hose that is usable is the four inch diameter hose marketed by Dayco Corporation of Dayton, Ohio, under the "U-11 Duravent" trademark.

As noted, the other end 80 of the hose 18 is connected to the inlet compartment subassembly 27. More specifically, and with reference to FIGS. 2–4, the subassembly 27 includes a top wall 84, a front wall 86, rear wall 88 and side walls 90. The top wall 84 includes a generally circular opening surrounded by an upstanding integral, cylindrical flange 92 that has a diameter substantially equal to that of the hose 18. The other end 80 of the hose fits over the flange 92 and a conventional clamp 82 secures the end 80 to the flange. This arrangement permits the matrix rope in the hose 18 to pass directly into the interior of the subassembly 27 and then into the compaction bin 28.

The lower ends of the front and rear walls 86 and 88 are curved so that the subassembly sits, like a saddle, on the upper half of a cylindrical wall 94 that forms and defines the cylindrical compaction bin 28. A pair of conventional clamp 95 are used to secure subassembly 27 on the wall 94.

The side walls 90 are formed of expanded metal so as to permit at least some of the pressurized air and oil flowing into the subassembly 27 to escape. The lower half of the wall 94 also includes a plurality of slots, shown generally at 96 that likewise permit the escape of pressurized air and oil. The flow of air and oil through the slots 96 and side walls 90 assists in moving the matrix waste into bin 28 and also in preventing the matrix waste from adhering to the walls of the subassembly 27.

As discussed above, the ram 30 is adapted to be reciprocated in the compaction bin 28. The central axes of the ram 30 and bin 29 are coaxial and the ram moves in a direction parallel to the central longitudinal axis of bin 28. The ram preferably has a diameter of approximately five inches. The ram is movable between a first position and a second position. When in its first position, its working face (that is, the face adapted to contact the matrix waste) is disposed in a plane substantially parallel with the plane of the rear wall 88 as best shown in FIG. 4. In this position, the ram 30 does not obstruct the introduction of matrix waste into the bin 28. When in its second position (shown by phantom lines in FIG. 4), the ram 30 is disposed beyond the plane of front wall 86. Movement of the ram 30 from its first position to its second position results in the compaction of matrix waste in the bin as hereinafter described.

A cylindrical shield 98 is secured, at its one or left-hand end, about the periphery of the ram 30 and extends toward the right, as shown in FIG. 4. The shield 98 prevents any matrix waste from falling or getting behind the ram 30 as the ram moves between its first and second positions. The length of the movement or stroke of the ram is approximately eight inches, and the length of the shield 98 is slightly greater of this stroke length.

A stationary, annular scraper 100 is mounted about the inner peripheral surface of the wall 94. When the ram 30 is in its first position, it is aligned with the scraper. The scraper 100 serves to scrape any matrix waste that might have adhered to the exterior surface of the shield 98 during the movement of the piston. This scraping occurs as the ram 30 is moved from its second position to its first position.

The cylindrical wall 94 extends to the right past the ram 30, when in its first position, to provide a spaced, protective cover for the shield 98 and for a substantial portion of the piston and cylinder subassembly 36. Its righthand end, as viewed in FIG. 4, is closed by a circular plate 102.

Figure 6:
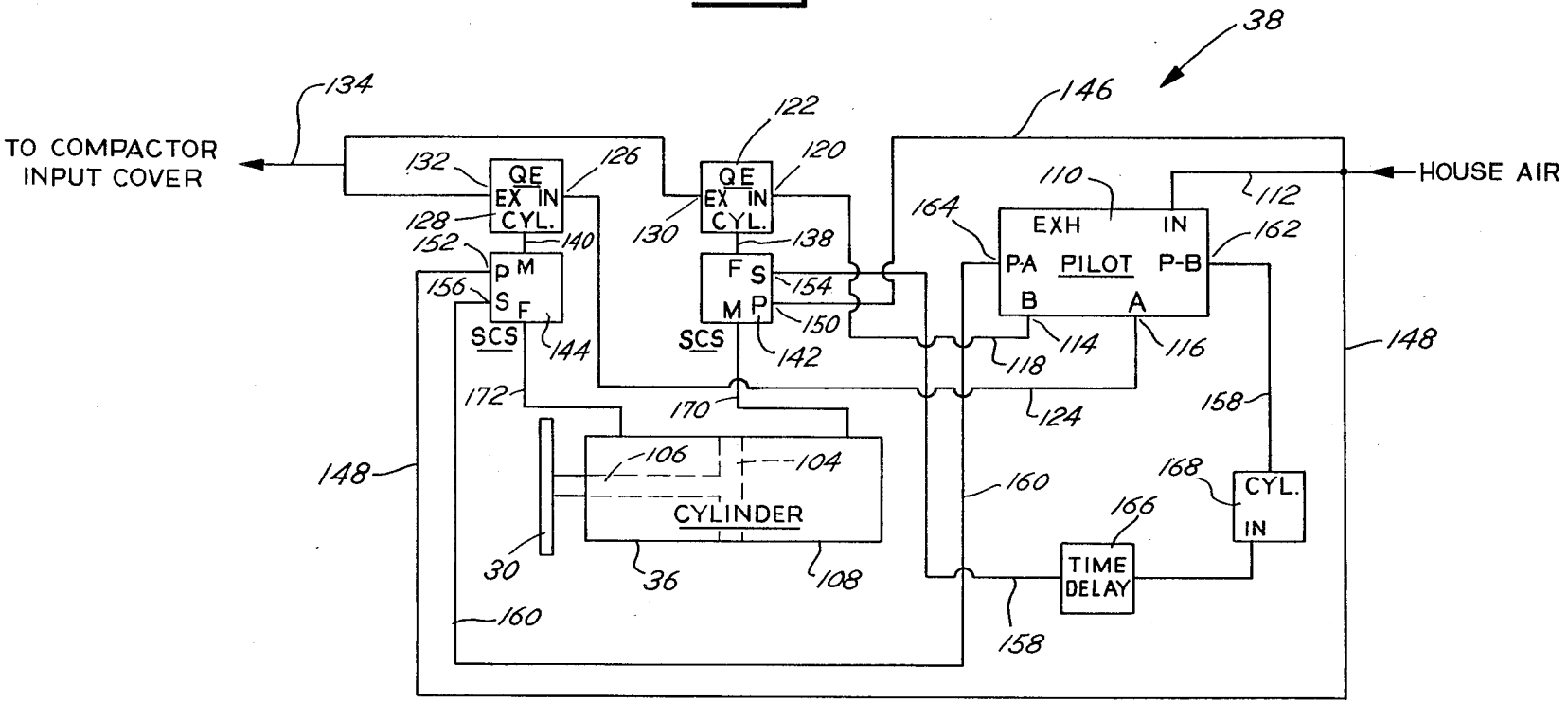
FIG. 6 is a diagrammatic view of the pneumatic circuit used to control the operation of the compactor of the improved system of the present invention.

The double-acting piston and cylinder subassembly 36 is of conventional design and construction. It functions in a conventional manner. As best seen in FIG. 6, the subassembly 36 includes a piston 104 that is connected with the ram 30 by a rod 106 and that may be moved within a cylinder 108. The piston 104 is moved within the cylinder 108 under the action or influence of air pressure within the cylinder.

The movement of the piston 104 within the cylinder 108 is controlled by the pneumatic circuit 38 shown in FIG. 6. More specifically, a source of house air, having a pressure of 80 psi or greater, is connected with a conventional pilot valve 110 by a conduit 112. Such a pilot valve 110 is marketed by Mac Valves Incorporated of Wixom, MI 48906, part No. 921A/RA. This valve serves to connect the house air alternatively with either of its outlet ports 114 or 116. Outlet port 114 is connected, via conduit 118, with inlet port 120 of a quick exhaust valve 122. Similarly, the outlet port 116 is connected, via conduit 124, with the inlet port 126 of a second, identical quick exhaust valve 128. The valves 122 and 128 are of conventional design and are marketed by Deltrol Fluid Products of Bellwood, IL 60104, part No. EV125.

The exhaust ports 130 and 132 of the valves 122 and 128, respectively, are connected with a common discharge line 134. This discharge line leads to a fitting 136 mounted on the top wall 84 of the subassembly 27. The pressurized air which flows through the line 135 and out through the fitting 136 facilitates the movement of the matrix waste into the compaction bin 28.

The valves 122 and 128 also communicate, via conduits 138 and 140, respectively, with conventional "stroke completion" sensors 142 and 144, respectively. These sensors provide an air signal when the ram motion stops, even when the full stroke length is not used. They work by tracking the pressure changes inside the cylinder 108. Once the pressure drops below a preselected value on the exhaust side of the cylinder, the sensors 142 and 144 will emit their air signal. Such sensors are marketed by Meade Fluid Dynamics, a division of Abex Corp. of 4114 N. Knox Avenue, Chicago, Ill. 60641, part No. SCS250.

House air also communicates, via conduits 146 and 148, with inlet ports 150 and 152 of the sensors 142 and 144, respectively. The signal ports 154 and 156 of the sensors 142 and 144, respectively, are connected, via conduits 158 and 160, with the signal ports 162 and 164, respectively, of the pilot valve 110.

A conventional time delay valve 166 is disposed within the conduit 158 between the sensor 142 and the valve 110. Such a time delay valve is also marketed by Mead Fluid Dynamics, identified above, part. No. KLG-105. A conventional, manually actuated valve 168 is disposed in the conduit 158, between the valves 110 and 166. This valve 168, in effect, functions as an off/on switch for the conduit 158.

The sensors 142 and 144 are also connected, via conduits 170 and 172, respectively, with the interior of the cylinder 108. Through the conduits 170 and 172, the sensors sense the pressure in the cylinder on opposite sides of the piston 104, with the sensor 144 sensing the pressure in the rod end or left-hand portion of the cylinder 108 and with the sensor 142 sensing the pressure in the other or right-hand portion of the cylinder, as viewed in FIG. 6. As noted, each of these sensors is designed to sense the pressure in its respective portion of the cylinder as that portion is being exhausted. They then provide an air signal when the sensed pressure drops below a predetermined value.

The operation of the circuit 38 is as follows and with reference to FIG. 6. Assuming that the ram 30 is being moved from its second position to its first position, house air is connected, via conduit 124, through quick exhaust valve 128, conduit 140, through valve 144 and conduit 172, with the rod end or left-hand portion of the cylinder 108. The pilot valve 110 has been shifted so that air signals in the conduits 118 and 124 cause the exit port 132 of the valve 128 to be closed while the exit port 130 of the valve 122 is to be open. Hence, air in the other or right-hand portion of the cylinder 108 will pass, through the sensor 142, conduit 138 and valve 122, to the discharge line 134 where, as noted, it will be discharged through fitting 136 and will assist in moving matrix waste in the subassembly 27 into the bin 28.

As the ram 30 reaches its first position, the air pressure in the other or right-hand portion of the cylinder 108, will drop below a preselected value. The sensor 142 senses this reduced pressure and provides an air signal, through port 154 and conduit 158, in response to this reduced pressure. This air signal passes through and is delayed for a preselected time by valve 166. The length of the delay is selected so as to be sure that the bin 28 is filled with matrix waste before the ram compaction stroke is begun. When the air signal from the sensor 142 reaches the port 162, the pilot valve 110 is caused to shift. This, in turn, causes the air signals in the conduits 118 and 124 to be reversed. Consequently, the exist port 130 in the valve 122 is closed, and the exist port 132 in the valve 128 is opened. House air in conduit 124 is then introduced, via the quick exhaust valve 122, conduit 138, valve 142, and conduit 170, into the other or right-hand end of the cylinder 108 thereby causing the ram 30 to move toward its second position. Similarly, the air in the rod end or left-hand position of the cylinder 108 will pass through the sensor 144, conduit 138, and valve 122 to the discharge line 134 thereby permitting this air to assist in moving matrix waste into the bin 28.

As the ram 30 reaches its second position, the pressure of the air in the rod-end or left-hand portion of the cylinder 108 will drop below the preselected value. This causes the sensor 144 to send an air signal, via port 156 and conduit 160, to port 164 of the pilot valve 110. This signal, in turn, causes the pilot valve to be shifted back to its original position, and the cycle of operation is repeated. In other words, the port 132 is closed and the port 130 is opened, due to the air signals in conduits 118 and 124 so that house air can again be supplied, via conduit 124, through valve 128, conduit 140, valve 144, and conduit 172 to the rod end or left-hand portion of the cylinder 108. At the same time, the air in the conduit 146 and in the other or right-hand portion of the cylinder 108 is again brought into communication with the discharge line 134. This, of course, causes the ram to again be moved toward its first position.

During the compaction stroke of the ram 30 (that is, during its movement toward its second position), the matrix waste in the bin 28 should preferably be compacted so that it is twelve to eighteen times as dense as it was in its uncompacted state. The compaction density is largely determined by the spring steel extrusion blade subassembly 32. This subassembly includes twelve spring steel flexure elements 176. Six of these elements are in a group, mounted side by side, across the upper portion of the distal open end 174 of the bin 28, which as noted, is defined by distal open end 174 of the bin 28, which as noted, is defined by the cylindrical wall 94. The other six elements are mounted in a group, side by side, across the lower part of the open end 174. As each group of six elements is mounted in an identical manner, only the structure for mounting for the upper group of elements 176 will be described here in detail.

As best shown in FIGS. 2–4, a pair of rectangular plates 178 and 180 are mounted vertically, adjacent to the end 174. These plates are spaced apart a distance slightly greater than the diameter of the bin 28, and the planes of the plates are parallel with the longitudinal axis of the bin 28. The two groups of elements 176 are mounted on and between these plates.

The ends of the six elements, forming the upper group, are supported in a mounting bar 182 by a plurality of bolts 184. The other or distal ends of the elements 176 are free to flex given the inherent resilience of the spring steel material from which they are made.

The bar 182 extends between the plates 178 and 180 pairs of bolts 186 and 178 are used to secure the ends of the bar 182 to the plates. The bolts 186 are generally aligned with the central longitudinal axis of the bar 182. Matching, aligned curved slots 190 are formed in the plates 178 and 180 so the shanks but not the heads of the bolts 188 may pass through these slots. The slots 190 are spaced radially from the holes in the plates for the bolts 186. The positions of the bolts 188, within the slots 190, determines the angle of the elements 176, mounted in the bar 182, with respect to the horizontal. This angle can be readily changed by loosening the bolts 186 and 188 and rotating the bar 182 about its central longitudinal axis.

Changing the angle of the elements 176 results in a change in the bais that will be exerted by the elements on the mass of the matrix waste being compacted in the bin 28. In other words, the matrix waste in the bin 28 is compacted within the bin by the ram 30 forcing the matrix waste against the groups of elements 176. The waste will be compacted until the force of compaction overcomes the bias of the elements and permits a compacted mass or bundle of matrix waste to pass between the flexed, distal ends of the elements 176. This compacted bundle then drops into the waste receptacle 34.

The distal ends of the elements 176 are disposed near the longitudinal center line of the bin 28. As noted, the elements are disposed at an acute angle with respect to the horizontal with the specific angle being dependent on the location of the bolts 188 in the slots 190. During initial operation of the system 10, the angle of the elements 176 should be adjusted so that an opening of approximately two and one half inches exists between the distal ends of the two groups of elements.

Four wedge-shaped, triangular members 192 are mounted about the periphery of the inside of the wall 94, adjacent to the end 174. These members are mounted at 90 degree angles with respect to each other and are arranged so that as shown in FIG. 4, their sloping surfaces faces the ram 30. These members function to prevent the bias of the elements 176 from forcing the compacted matrix waste bundles back into the bin 28 during the ram return stroke (that is, as the ram 30 moves from its second position to its first position).

To the extent that they come into contact with the matrix waste, the walls of the subassembly 27 and the compaction bin 28 are coated with RTV silicone rubber marketed by General Electric Company, of Waterford, NY 12188, product No. RTV112 white. The face of the ram 30 and the outer peripheral wall of the ram shield 98 are coated with an epoxy silica sand mixture, which then is lightly coated with RTV silicone rubber. These coatings substantially prevent the unwanted sticking of the matrix waste and minimize the abrasive wear that would otherwise be caused by the matrix waste.

As will be apparent to those having ordinary skill in this art, the operation of the system 10 affords an improved method for efficiently removing and disposing of a continuous generally planar web of matrix waste formed during the high speed manufacture of adhesive backed pressure sensitive label stock on a printing press. Thus the generally planar web of matrix waste is converted into continuous, crumbled, generally tubular rope of matrix waste. This tubular matrix waste rope is then compacted into relatively compact bundles of matrix waste. Thereafter these compacted bundles are deposited in a waste receptacle.

I claim:

1. An improved system for efficiently removing and disposing of a continuous, generally planar web of matrix waste formed during the high speed manufacture of adhesive backed pressure sensitive label stock on a printing press, the improved system comprising:

means for creating a continuous high volume stream of pressurized air, this creating means including a low pressure, high volume rotary blower;

means for converting the continuous web of matrix waste into a continuous crumpled, generally tubular rope of matrix waste, the converting means including an eductor having an upstream end, a central passageway and a downstream end, these ends and central passageway having a lining resistant to abrasion and adhesion with regard to the adhesive on the matrix waste, with the web of matrix waste being continuously funneled into the upstream end of the eductor and the rope of matrix waste passing through the central passageway of and out through the downstream end of the eductor;

means for compacting the rope of matrix waste into relatively compact bundles of matrix waste;

means for moving the rope of matrix waste from the converting means to the compaction means, the moving means includes a flexible hose that is connected at its one end with the downstream end of the eductor and that has its other end disposed adjacent to the compaction means, and with the stream of air being introduced into the eductor, about the periphery of the rope of matrix waste, as the rope of matrix waste passes through the central passageway of the eductor and serving to move the rope of matrix waste through the eductor and hose and into the compacting means;

means for mixing and introducing a metered preselected amount of oil into the air stream at the inlet of the blower so that the oil becomes atomized and thoroughly mixed in the air stream in the blower so as to facilitate movement of the rope of matrix waste through the eductor and the hose and to minimize build-up of deposits of ink in the eductor and hose; and means for receiving compacted bundles of matrix waste after the compacted bundles of matrix waste have been compacted by the compaction means.

2. The improved system described in claim 1 wherein the converting means includes a cylindrical passageway through which the web of matrix waste is continuously funneled and which has a lining resistant to adhesion and abrasion with regard to the adhesive on the matrix waste.

3. The improved system described in claim 1 which includes means for guiding the web of matrix waste away from the rest of the label stock as the label stock is running on the printing press.

4. The improved system described in claim 3 wherein the guiding means includes a roller having a surface lining resistant to abrasion and adhesion with regard to the adhesive on the matrix waste; and wherein the roller is mounted on the printing press.

5. An improved system for efficiently removing and disposing of a continuous, generally planar web of matrix waste formed during the high speed manufacture of adhesive backed pressure sensitive label stock on a printing press, the improved system comprising:

means for converting the continuous web of matrix waste into a continuous crumpled, generally tubular rope of matrix waste;

means for compacting the rope of matrix waste into relatively compact bundles of matrix waste, the compaction means including a generally cylindrical compacting bin having a first end, a second end, a generally cylindrical side wall extending between the first and second ends, and an opening in the side wall of the bin for receiving portions of the rope of matrix waste; a generally cylindrical, reciprocating ram mounted adjacent to the first end of the bin for movement in the bin along a first axis from the first end of the bin to the second end of the bin during a compacting stroke and from the second end to the first end of the bin during a retracting stroke, the ram having a shape, generally congruent to the shape of the cross-section of the bin perpendicular to the first axis and having dimensions substantially equal to the cross-sectional dimensions of the bin so that the portion of the rope of matrix waste introduced into the bin through the side opening will be compacted by the movement of the ram toward the second end of the bin during the compacting stroke of the ram; means for intermittently moving the ram through its compacting and retracting strokes; the second end of the bin comprising first and second opposed groups of spring steel flexure members, with each of the flexure members having first and second ends; and with the compaction means further including means for mounting the first ends of the first group of flexure members in a first row along a first portion of the second end of the side wall of the bin; and means for mounting the first ends of the second group of flexure members in a second row along a second portion of the second end of the side wall of the bin, with the first and second portions of the side wall being diametrically opposed to one another, and with the second ends of the first and second rows of flexure members being disposed adjacent to each other along lines that are generally perpendicular to the first axis and that are spaced away from the ram so that when the ram has reached the end of its compacting stroke, a generally triangular space is defined between the ram and the flexure members; and where the movement of the ram, during its compacting stroke, compacts the portion of the rope of matrix waste within the bin against the flexure members until the force on the compacted bundle of matrix waste, imposed by the ram, overcomes the bias of the flexure members so as to permit the compacted bundle to be pushed out of the second end of the bin;

means for moving the rope of matrix waste from the converting means to the compaction means; and means for receiving compacted bundles of matrix waste after the compacted bundles of matrix waste have been compacted by the compaction means.

6. The improved system described in claim 5 wherein means for intermittently moving the ram includes a double acting, pressurized air actuated piston.

7. The improved system described in claim 5 which includes means for preventing the spring biasing force of the flexured members from causing a compacted bundle to reenter the bin as the ram is moved along its retracting stroke.

8. The improved system described in claim 7 wherein the prevention means includes a plurality of triangularly shaped wedges disposed on and around the side wall of the bin adjacent to the second end of the bin.

9. The improved system described in claim 5 wherein the means for mounting the first ends of the flexured members includes means for adjusting the angle of the flexure members, vis-a-vis the first axis, and thus the bias exerted by the fixture members.

10. The improved system described in claim 5 wherein the converting means includes a cylindrical passageway through which the web of matrix waste is continuously funneled and which has a lining resistant to adhesion and abrasion with regard to the adhesive on the matrix waste.

11. The improved system described in claim 5 which includes means for guiding the web of matrix waste away from the rest of the label stock as the label stock is running on the printing press.

12. The improved system described in claim 11 wherein the guiding means includes a roller having a surface lining resistant to abrasion and adhesion with regard to the adhesive on the matrix waste; and wherein the roller is mounted on the printing press.

13. The improved system described in claim 12 wherein the converting means includes a cylindrical passageway through which the web of matrix waste is continuously funneled and which has a lining resistant to adhesion and abrasion with regard to the adhesive on the matrix waste.

14. The improved system described in claim 13 which includes means for guiding the web of matrix waste away from the rest of the label stock as the label stock is running on the printing press.

15. The improved system described in claim 14 wherein the guiding means includes a roller having a surface lining resistant to abrasion and adhesion with regard to the adhesive on the matrix waste; and wherein the roller is mounted on the printing press.

16. An improved system for efficiently removing and disposing of a continuous, generally planar web of matrix waste formed during the high speed manufacture of adhesive backed pressure sensitive label stock on a printing press, the improved system comprising:

means for creating a continuous stream of pressurized air;

means for converting the continuous web of matrix waste into a continuous crumpled, generally tubular rope of matrix waste, the converting means including an eductor having an upstream end, a central passageway and a downstream end, these ends and central passageway having a lining resistant to abrasion and adhesion with regard to the adhesive on the matrix waste, and with the web of matrix being continuously funneled into the upstream end of the eductor and the rope of matrix waste passing through the central passageway of and out through the downstream end of the eductor;

means for compacting the rope of matrix waste into relatively compact bundles of matrix waste, the compaction means including: a generally cylindrical compacting bin having a first end, a second end, a generally cylindrical side wall extending between the first and second ends, and an opening in the side wall of the bin for receiving portions of the rope of matrix waste, a generally cylindrical, reciprocating ram that is mounted adjacent to the first end of the bin for movement in the bin along a first axis from the first end of the bin to the second end of the bin during a compacting stroke and from the second end to the first end of the bin during a retracting stroke, the ram having a shape generally congruent to the shape the cross-section of the bin perpendicular to the first axis and having dimensions substantially equal to the cross-sectional dimensions of the bin so that the portion of the rope of matrix waste introduced into the bin through the side opening will be compacted by the movement of the ram toward the second end of the bin during the compacting stroke of the ram; means for intermittently moving the ram through its compacting and retracting strokes; with the second end of the bin being comprised of first and second opposed groups of spring steel flexure members, each of the flexure members having first and second ends; and with the compaction means further including means for mounting the first ends of the first group of flexure members in a first row along a first portion of the second end of the side wall of the bin; and means for mounting the first ends of the second group of flexure members in the second row along a second portion of the second end of the side wall of the bin, with the first and second portions of the side wall being diametrically opposed to one another; with the second ends of the first and second rows of flexure members being disposed adjacent to each other along lines that are generally perpendicular to the first axis and that are spaced away from the ram so that when the ram has reached the end of its compacting stroke, a generally triangular space is defined between the ram and the flexure members; and where the movement of the ram, during its compacting stroke, compacts the portion of the rope of matrix waste within the bin against the flexure until the force on the compacted bundle of matrix waste, imposed by the ram, overcomes the bias of the flexure members so as to permit the bundle to be pushed out of the second end of the bin;

means for moving the rope of matrix waste from the converting means to the compaction means, the moving means including a flexible hose that is connected at its one end with the downstream end of the eductor; and with the stream of pressurized air being introduced into the eductor, about the periphery of the rope of matrix waste, as the rope of matrix waste passes through the central passageway of the eductor, and serving to move the rope of matrix waste through the eductor and hose and into the bin of the compaction means;

means for mixing oil with the stream of pressurized air so as to facilitate movement of the rope of matrix waste through the eductor and the hose and to minimize build-up of deposits of ink in the eductor and hose; and means for receiving compacted bundles of matrix waste after the compacted bundles of matrix waste have been compacted by the compaction means.

17. The improved system described in claim 16 which includes means for preventing the spring biasing force of the flexure members from causing the compacted bundle to reenter the bin as the ram is moved along its retracting stroke.

18. The improved system described in claim 16 wherein the means for mounting the first ends of the flexure members includes means for adjusting the angle of the flexure members, vis-a-vis the first axis, and thus the bias exerted by the flexure members.

19. The improved system described in claim 18 wherein the inside of the side wall of the bin and the face of the ram, directed toward the second end of the bin, have a lining resistant to adhesion and abrasion with regard to the adhesive on the matrix waste.

20. The improved system described in claim 19 wherein a second end of the hose is disposed above the opening in the side wall of the bin so that gravity as well as pressurized air assists the entry of a portion of the rope of matrix waste enter the side opening of the bin for compaction therein; and wherein the side wall of the bin includes a plurality of relatively small apertures to permit the escape of pressurized air from within the bin.

21. The improved system described in claim 20 which includes means for guiding the web of matrix waste away from the rest of the label stock as the label stock is running on the printing press.

22. The improved machine described in claim 21 wherein means for intermittently moving the ram includes a double acting, pressurized air actuated piston.

23. An improved machine for efficiently compacting a crumpled rope of matrix waste formed during the high speed manufacture of two ply, die cut adhesive backed pressure sensitive label stock on a printing press, the improved machine comprising:

a generally cylindrical compacting bin having a first end, a second end, a generally cylindrical side wall extending between the first and second ends and an opening in the side wall of the bin for receiving portions of the rope of matrix waste; a generally cylindrical, reciprocating ram that is mounted adjacent to the first end of the bin for movement in the bin along a first axis from the first end of the bin to the second end of the bin during a compacting stroke and from the second end to the first end of the bin during a retracting stroke, the ram having a shape generally congruent to the shape the cross section of the bin perpendicular to the first axis and having dimensions substantially equal to the cross-sectional dimensions of the bin so that the portion of the rope of matrix waste introduced into the bin through the side opening will be compacted by the movement of the ram toward the second end of the bin during the compacting stroke of the ram; means for intermittently moving the ram through its compacting and retracting strokes, with the second end of the bin being comprised of first and second opposed groups of spring steel flexure members, each of the flexure members having first and second ends; means for mounting the first ends of the first group of flexure members in a first row along a first portion of the second end of the side wall of the bin; means for mounting the first ends of the second group of flexure members in the second row along a second portion of the second end of the side wall of the bin, with the first and second portions of the side wall being diametrically opposed to one another; with the second ends of the first and second rows of flexure members being disposed adjacent to each other along lines that are generally perpendicular to the first axis and that are spaced away from the ram so that when the ram has reached the end of its compacting stroke, a generally triangular space is defined between the ram and the flexure members; and where the movement of the ram, during its compacting stroke, compacts the portion of the rope of matrix waste within the bin against the flexure members until the force on the compacted bundle of matrix waste overcomes the bias of the flexure members so as to permit the bundle to be pushed out of the second end of the bin.

24. The improved machine described in claim 23 wherein means for intermittently moving the ram includes a double acting, pressurized air actuated piston.

25. The improved machine described in claim 23 which includes means for preventing the flexured members from causing the compacted bundle to reenter the bin as the ram is moved along its retracting stroke.

26. The improved machine described in claim 25 wherein the prevention means includes a plurality of triangularly shaped wedges disposed on and around the side wall of the bin adjacent to the second end of the bin.

27. The improved machine described in claim 23 wherein the means for mounting the first ends of the flexure members includes means for adjusting the angle of the flexure members vis-a-vis the first axis and thus the bias exerted by the flexure members.

28. The improved machine described in claim 25 wherein the means for mounting the first ends of the flexure members includes means for adjusting the angle of the flexure members vis-a-vis the first axis and thus the bias exerted by the flexure members; wherein the ram carries means for blocking the opening in the side of the bin so as to prevent ingress and egress of the rope of matrix waste during the compacting stroke; and wherein the first end of the bin includes means for scraping matrix waste from the ram and the blocking means as the ram moves through its retracting stroke.

29. The improved machine described in claim 28 wherein the prevention means includes a plurality of triangularly shaped wedges disposed on and around the side wall of the bin adjacent to the second end of the bin.

30. The improved machine described in claim 29 wherein means for intermittently moving the ram includes a double acting, pressurized air actuated piston.

31. An improved machine for efficiently compacting a crumped rope of matrix waste formed during the high speed manufacture of two ply, die cut adhesive backed pressure sensitive label stock on a printing press, the improved machine comprising:

a generally cylindrical compacting bin having a first end, a second end, a generally cylindrical side wall extending between the first and second ends and an opening in the side wall of the bin for receiving portions of the rope of matrix waste; a generally cylindrical, reciprocating ram that is mounted adjacent to the first end of the bin for movement in the bin along a first axis from the first end of the bin to the second end of the bin during a compacting stroke and from the second end to the first end of the bin during a retracting stroke, the ram having a shape generally congruent to the shape the cross section of the bin perpendicular to the first axis and having dimensions substantially equal to the cross-sectional dimensions of the bin so that the portion of the rope of matrix waste introduced into the bin through the side opening will be compacted by the movement of the ram toward the second end of the bin during the compacting stroke of the ram; and means for intermittently moving the ram through its compacting and retracting strokes; with the inner surface of the side wall of the bin having a lining resistant to adhesion with regard to the adhesive on the matrix waste; and with the face of the ram, directed toward the second end of the bin, having a lining resistant to adhesion and abrasion with regard to the adhesive on the matrix waste.

32. An improved method for efficiently removing and disposing of a continuous, generally planar web of matrix waste formed during the high speed manufacture of adhesive backed pressure sensitive label stock on a printing press including the steps of:

converting the continuous web of matrix waste into a continuous, crumpled, generally tubular rope of matrix waste as the web enters and passes through a cylindrical eductor means;

injecting a continuous high volume, pressurized stream of air around the periphery of the continuous rope of matrix waste in the eductor means after the web of matrix waste has been converted to the continuous rope of matrix waste, and mixing oil with the high volume, pressurized stream of air so as to facilitate the movement of the continuous tubular rope of matrix waste and to minimize build-up of deposits of ink;

moving the continuous rope of matrix waste to a means for compacting the rope of matrix waste;

intermittently depositing the leading portion of the continuous rope of waste into the compaction means;

intermittently compacting the portion of the continuous rope of matrix waste into relatively compact bundles of matrix waste; and depositing the compacted bundles of matrix waste to a waste disposal receptacle.

33. The improved method described in claim 32 which includes the step of guiding the continuous web of matrix waste away from the rest of the label stock while running on the printing press.

34. The improved method described in claim 32 wherein the movement of the rope of matrix waste occurs through a tube having an inner surface resistant to abrasion and to adhesion with regard to the adhesive on the matrix waste.

35. An improved method for efficiently removing and disposed of a continuous, generally planar web of matrix waste formed during the high speed manufacture of adhesive backed pressure sensitive label stock on a printing press including the steps of:

converting the continuous web of matrix waste into a continuous, crumpled, generally tubular rope of matrix waste;

injecting a continuous high volume, pressurized stream of air around the periphery of the continuous rope of matrix waste after the web of matrix waste has been converted to the continuous rope of matrix waste;

moving the continuous rope of matrix to a means for compacting the rope of matrix waste;

intermittently depositing the leading portion of the continuous rope of waste into the compaction means;

intermittently compacting the portion of the continuous rope of matrix waste into relatively compact bundles of matrix waste; with the compacting occurring by the action of an intermittently operated, reciprocating piston ram acting, in a cylindrical perforated walled bin, along a first axis and against relatively stiff but yieldable flexure means; and with the portion of the rope of matrix waste being deposited in the bin along a path generally perpendicular to the first axis; and depositing the compacted bundles of matrix waste to a waste disposal receptacle.

36. The improved method described in claim 35 which includes the step of mixing oil with the high volume, pressurized stream of air so as to facilitate the movement of the rope of matrix waste and to minimize build-up of deposits of ink.

37. The improved method described in claim 36 wherein the converting step occurs as the web enters and passes through a cylindrical eductor means; and wherein the air injection step occurs in the eductor means.

38. The improved method described in claim 35 wherein the movement of the rope of matrix waste occurs through a tube having an inner surface resistant to abrasion and to adhesion with regard to the adhesive on the matrix waste.

39. The improved method described in claim 35 wherein the movement of the rope of matrix waste occurs through a tube having an inner surface resistant to abrasion and to adhesion with regard to the adhesive on the matrix waste.

* * * * *